United States Patent [19]

Billingsley

[11] Patent Number: 4,610,472

[45] Date of Patent: Sep. 9, 1986

[54] LOCK FOR CASEMENT WINDOWS

[75] Inventor: Michael J. Billingsley, Pella, Iowa

[73] Assignee: Rolscreen Company, Pella, Iowa

[21] Appl. No.: 438,784

[22] Filed: Nov. 3, 1982

[51] Int. Cl.[4] ..... E05C 3/04

[52] U.S. Cl. ..... 292/54; 292/241; 292/DIG. 35; 292/DIG. 47; 292/DIG. 62

[58] Field of Search ..... 292/240, DIG. 33, DIG. 35, 292/DIG. 47, DIG. 62, 11, 45–48, 52, 54, 241, 44, 53; 70/DIG. 42

[56] References Cited

U.S. PATENT DOCUMENTS

| | | | |
|---|---|---|---|
| 1,163,795 | 12/1915 | Voight | 292/48 X |
| 1,626,432 | 4/1927 | Shaw | 292/48 X |
| 2,369,584 | 2/1945 | Lundholm | 292/240 |
| 2,486,905 | 11/1949 | Ackermans | 292/240 |
| 2,569,046 | 9/1951 | Endter | 292/240 |
| 2,586,648 | 2/1952 | Hale et al. | 292/240 |
| 2,716,262 | 8/1955 | Oswald | 292/240 |
| 2,745,132 | 5/1956 | Clark et al. | 292/48 X |
| 2,789,851 | 4/1957 | Lickteig | 292/240 |
| 2,824,440 | 2/1958 | Jewett et al. | 292/48 X |
| 2,831,718 | 4/1958 | Hallek et al. | 292/240 |
| 2,944,864 | 7/1960 | Krivulka | 292/240 |
| 4,003,614 | 1/1977 | Geer et al. | 292/240 |

FOREIGN PATENT DOCUMENTS

| | | | |
|---|---|---|---|
| 191850 | 10/1907 | Fed. Rep. of Germany | 292/45 |
| 269296 | 11/1929 | Italy | 292/240 |
| 182573 | 8/1936 | Switzerland | 292/240 |
| 6138 | of 1906 | United Kingdom | 292/240 |

*Primary Examiner*—Gary L. Smith
*Assistant Examiner*—Lloyd A. Gall
*Attorney, Agent, or Firm*—Zarley, McKee, Thomte, Voorhees & Sease

[57] ABSTRACT

An improved casement window securement mechanism includes two cams, one handle, cam linkage and a cam and linkage supporting spacer. The spacer supported cam is a reaching cam including a cam ramp with a straight drawing portion, and cam center and over-center portions. The reaching cam draws a catch at a rate varying with the cam angle of rotation. The securement mechanism draws and positively secures a bowed or warped casement sash.

8 Claims, 5 Drawing Figures

LOCK FOR CASEMENT WINDOWS

BACKGROUND OF THE INVENTION

This invention relates to an improved casement window securement mechanism, and more particularly, to a new reaching cam, cam spacer and other components of such a mechanism.

A casement window is a window with a sash hinged to one side. Basic casement windows are usually each provided with a crank at the window bottom for opening and closing the window sash, and one or two mechanisms for securing the sash when closed. Each securement mechanism includes a cam and attached handle. The sash includes two catches. After the sash is closed, each cam is separately, manually rotated by its handle to capture a catch, and secured the sash.

Another, better securement mechanism includes two cams, one handle, and a link joining the two cams. With such a mechanism, both cams are rotated by the one handle.

In both the basic and better securement mechanisms, difficulties have been encountered in securement of the window sash at the top, or more generally, away from the window crank. This is because closed window sashes tend to warp, or bow outward at the top, away from the window frame, such that the top cam cannot capture its cooperating catch.

SUMMARY OF THE INVENTION

In a principal aspect, this invention is an improved casement window securement mechanism comprising first and second cams, linkage connecting the cams, and a cam spacer for the second cam. The first cam is rotatable, and has a cam ramp and handle. The second cam is rotatable, and has a cam ramp, but no handle. The linkage connects the cams for rotation of the second cam in response to rotation of the first cam. The cam spacer, which is in itself a significant feature of the invention, supports the second cam against the forces and moments of closure during rotation of the second cam. The cam spacer so supports the second cam by supporting it against axial movement along its axis of rotation and against pivotal movement of its axis of rotation.

The cam spacer also guides and supports movement of the end of the linkage adjacent the second cam, frees the linkage from the forces and moments of closure, distributes the forces of closure over the frame jamb, and locates itself on the jamb.

In another principal aspect, this invention is an improved casement window securement mechanism which includes the two cams, the handle and the linkage, where the second cam is a unique, reaching cam having a cam ramp with a drawing portion on which the drawing portion surface is straight. So constructed, the second cam can draw a catch at a rate varying with the cam angle of rotation.

The second cam ramp also has a catch center portion and a catch over-center portion, such that after sash securement the catch center portion of the cam ramp must be forcibly rotated past the catch to release the sash.

A casement window securement mechanism with one or more of these features is a significant improvement over prior securement mechanisms in that the second cam draws and positively secures a bowed or warped sash.

Thus, an object of this invention is to provide an improved casement window securement mechanism.

Another object is to provide such a mechanism which draws and positively secures a sash.

BRIEF DESCRIPTION OF THE DRAWING

The accompanying drawing includes five figures or views.

Finally.

DETAILED DESCRIPTION OF THE PREFERRED EMBODIMENT

Figure 1:
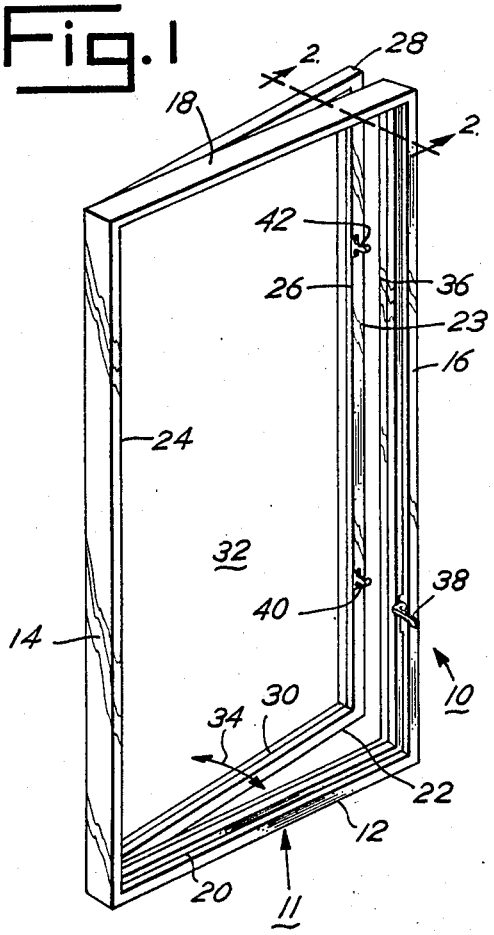
FIG. 1 is a perspective view of a casement window including the preferred casement window securement mechanism of this invention. For clarity, the window crank mechanism is not illustrated.

Referring to FIG. 1, the preferred embodiment of this invention is a casement window securement mechanism 10 for a casement window such as the illustrated window 11. A frame 12 of two spaced, frame jambs 14, 16, a head 18 and a sill 20 defines an opening for a window sash 22. The sash 22 includes a sash frame 23 of two spaced, sash frame sides 24, 26 and two spaced, sash frame ends 28, 30 about a sash panel 32.

The sash frame side 24 is hinged to the frame jamb 14 so that the sash 22 swings toward and away from the frame 12 in the directions of arrow 34 of FIG. 1. When the sash 22 is swung toward the frame 12, and secured, as will be described, the sash frame 23 contacts a resilient seal 35, shown only in FIG. 4, mounted on the frame 12, and rests adjacent frame stops mounted on the frame 12, such as frame stop 36 mounted on the frame jamb 16.

When the window 11 is viewed from within, with the sash 22 closed and secured, the only visible component of the mechanism 10 is a handle 38. The remaining components are concealed by the frame stop 36. When the window is opened, two sash catches, a first or lower sash catch 40, and a second or upper sash catch 42 become visible from within, on the sash frame side 26, as in FIG. 1.

Figure 2:
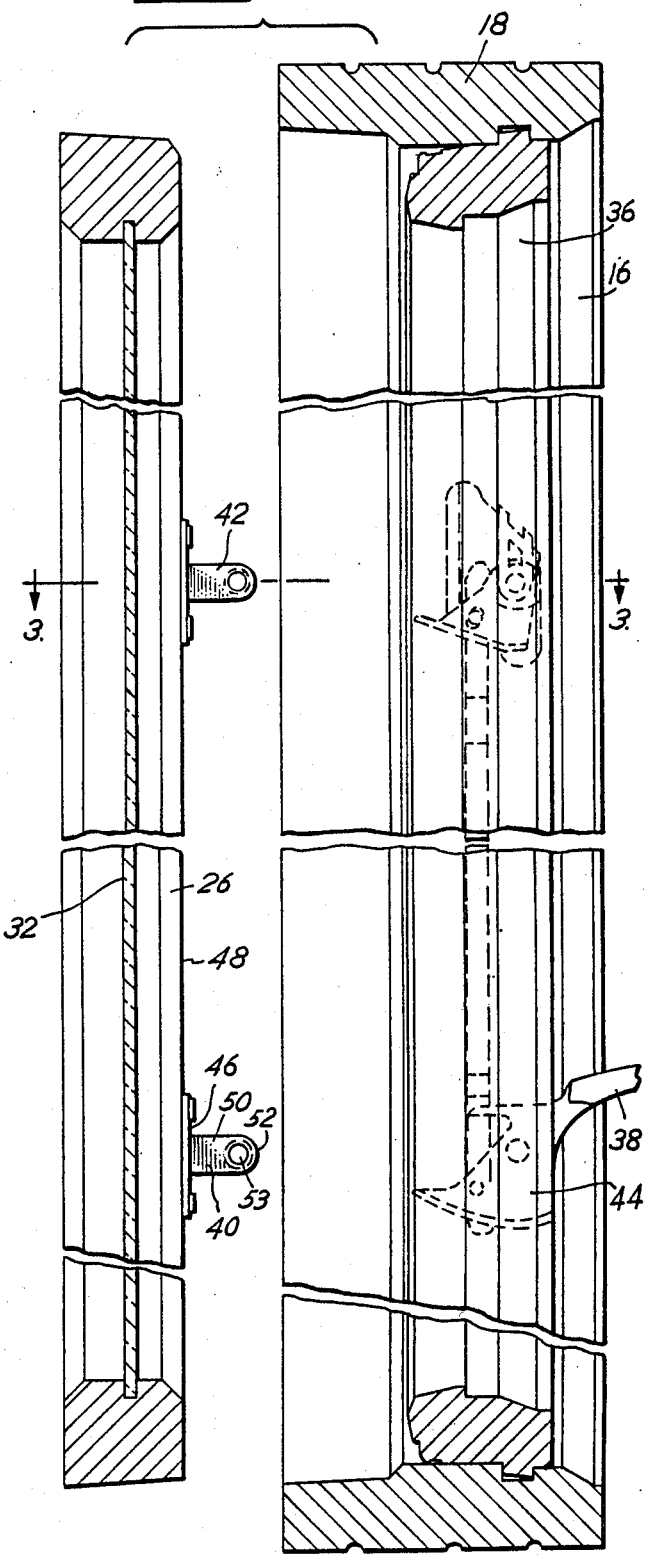
FIG. 2 is a section view of the window of FIG. 1, taken along line 2—2 of FIG. 1, with the window sash to the left and the window frame to the right. The preferred securement mechanism is shown in phantom on the frame.
Figure 4:
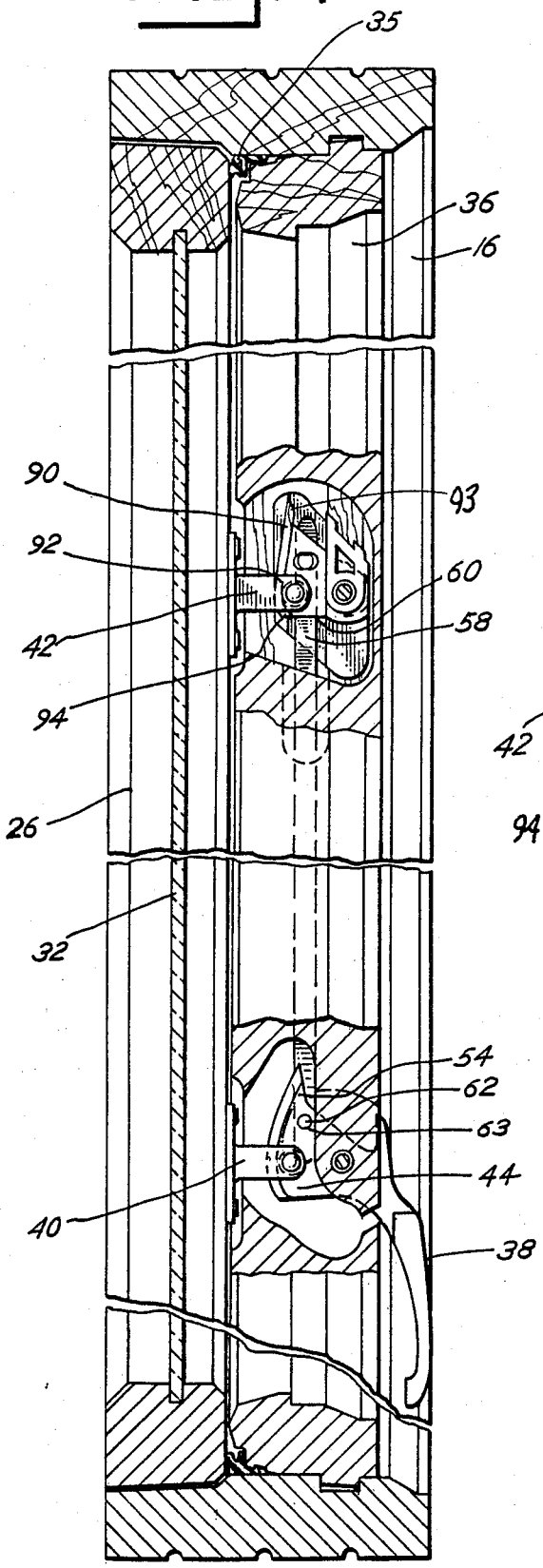
FIG. 4 is a section view similar to FIG. 2, but with the sash closed against the frame, and with the two cams of the preferred securement mechanism shown by breaking away portions of the frame stop.

Referring to FIGS. 2 and 4, the sash catch 40 cooperates with a first or lower securement cam 44. A sash catch base 46 of the catches 40, 42 is fastened to the inward-facing face 48 of the sash frame side 26, and a stand-off 50 extends from the base 46 to a free end 52, where a sash catch roller 53 is fastened. The roller 53 is rotatable about a horizontal axis along its center.

The cam 44 includes a curved cam ramp 54 and the handle 38. As best seen by comparing FIGS. 2 and 4, the cam 44 is mounted to the frame jamb 16 for manual rotation, by manipulation of the handle 38, about a first cam axis. When the sash 22 is closed, rotation of the handle 38 downward from the position of FIG. 2 to the position of FIG. 4 causes the cam ramp 54 to rotate upward, behind the sash catch roller 53. The cam 44 and sash catch 40 thus cooperatively secure the first or lower end of the sash 22.

A vertical cam link 58 extends upward from the cam 44 to a second or upper cam 60, in a routed groove between the frame stop 36 and the frame jamb 16. The link 58 has a first cam link stud 62 at its lower end, which is loosely mounted within a close-fitting stud opening 63 to the cam 44, between the cam 44 and frame jamb 16. The opening 63 is spaced from the first cam rotational axis, and thus, rotation of the handle 38 downward from the position of FIG. 2 to that of FIG. 4 drives the link 58 upward. Return rotation of the handle 38 pulls the link 58 downward.

The upper cam 60 also includes a cam ramp 64 but excludes any handle. Moreover, the cam ramp 64 is shaped unlike the cam ramp 54, and the cam 60 is not mounted directly to the frame jamb 16.

Figure 3:
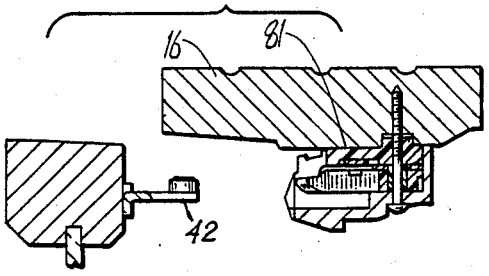
FIG. 3 is a section view of the window of FIGS. 1 and 2, taken along line 3—3 of FIG. 2, through the rotational axis of the second cam of the preferred securement mechanism.
Figure 5:
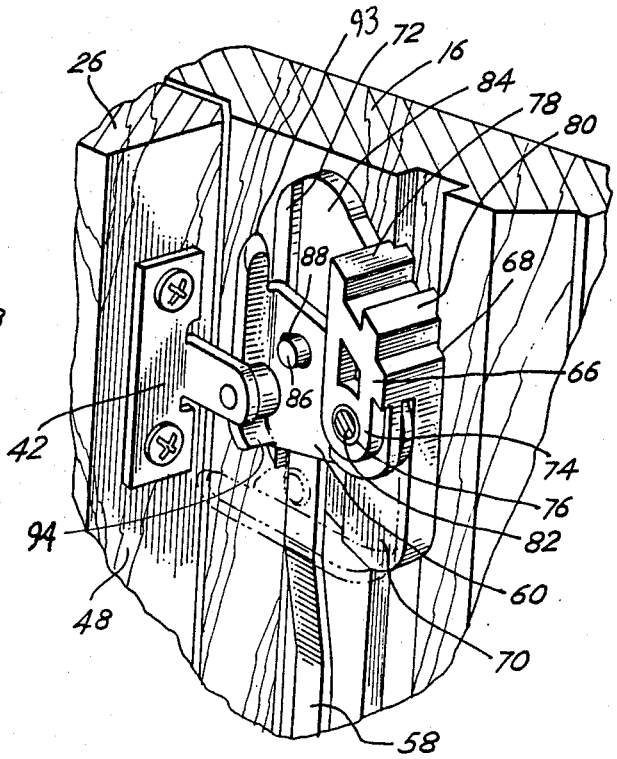
FIG. 5 is a perspective view of the second cam and surrounding window components. The cam is shown in two positions of rotation, with one position shown in phantom.

Referring to FIGS. 3, 4 and 5, the upper cam 60 is mounted to the mounting post 66 of a cam spacer 68, and supported throughout its rotational travel upon two spaced cam support ridges 70, 72. The cam spacer 68 includes a jamb frame locator flange 73 for mating with a frame jamb slot 75 and locating the cam spacer 68 on the frame jamb 16. A frame jamb contacting surface 81 distributes forces of closure of the sash 22 over the frame jamb 16. The post 66 includes a fastener flange 74 with a fastener opening 76, and two ribs 78, 80. The cam 60 fits between the ridge 70 and flange 74, and is fastened to the spacer 68 and frame jamb 16 by a fastener 82 extending through the opening 76. The ribs 78, 80 eliminate significant flexure of the fastener flange 74, and allow the fastener 82 to be tightened without binding of the cam 60. The ribs 78, 80 also strengthen the post 66, to prevent significant flexure of the post 66 and thereby support the cam 60 against pivotal movement of the horizontal axis of rotation of the cam 60. The ridges 70, 72, support the cam 60 against axial movement toward the frame jamb side 16. Thus, the cam 60 is rotatable about a rigid second horizontal cam axis, defined by the fastener 82.

Between the ridges 70, 72 the spacer 68 defines a channel 84. The upper end of the cam link 58 extends into the channel 84, and is guided to remain in the channel 84 by the ridges 70, 72. The upper link end is supported by the linkage end support surface of the channel 84. A second cam link stud 86 is located on the upper cam link end, and engages a second stud opening 88 in the upper cam 60. The link 58 thus connects the two cams 44, 60, for rotating the upper cam 60 in response to rotation of the lower cam 44. The link 58 is guided and supported in its movement by the spacer 68.

As best shown in FIG. 4, the cam ramp 64 includes a drawing portion 90, a catch center portion 92 and a catch over-center portion 93. The surface of the drawing portion 90 is substantially straight in a plane parallel to the second cam axis. An end portion 94 of cam ramp 64 is curved towards the second cam axis so as to prevent catch 42 from becoming disengaged from cam ramp 64 when sash 22 is closed.

The drawing portion 90 is elongated, and thus, the ramp 64 engages the catch 42 at a great distance of the sash frame side 26 from the jamb stop 36. The drawing portion 90 draws the catch 42 at a rate varying with the cam rotation angle. As the cam 60 is first rotated from the position of FIG. 2, the portion 90 draws the catch 42 a great distance, while as the cam 60 approaches the position of FIGS. 4 and 5, the portion 90 draws the catch 42 at a rate about equal to the rate of draw of the cam 44. The cam 60 thus accomodates a bowed or warped sash 22 by drawing the catch 42 the necessary distance for securement in a time no greater than the time that the cam 44 draws the catch 40 for securement.

To further assure the capture of the catch 42 by the cam 60, the second stud opening 88 is elongated or oblong, with a minimum dimension providing a snug fit with the cam stud 86. The opening 88 is positioned on the cam 60 such that in the position of FIG. 2, the greater dimension of the opening 88 is substantially vertically aligned or parallel to the extent and drawing direction of the cam link 58. In the position of FIGS. 4 and 5, the greater dimension of the opening 88 is substantially horizontally aligned, or perpendicular to the extent and driving direction of the link 58. The greater dimension of the opening 88 is such that in a brief time interval when the handle 38 is first rotated toward the position of FIGS. 4 and 5, the stud 86 slides in the opening 88 and the second cam 60 remains motionless. Thus, the second cam 60 momentarily lags behind the first cam 44. This delay allows the first cam 44 to capture and partially draw in the sash catch 40. The sash 22 is drawn with the catch 40, and as a result, the catch 42 is better positioned for capture.

As the cam 60 is finally rotated toward the position of FIGS. 4 and 5, the captured sash catch 42 contacts the catch center portion 92 of the ramp 64. The sash frame 23 simultaneously contacts and compresses the seal 35. The catch 42 then reaches the over-center portion 93 of the ramp 64. The pressure of the seal 35 on the sash frame 23 causes the sash 22 to move slightly away from the window frame 12, with the catch 42 remaining in contact with the ramp 64. The increased compression on the seal 35 required to move the catch 42 to and past the center portion 92 thus acts to positively secure the sash 22.

The preferred embodiment of the invention is now described. As should be apparent various modifications could be made to the preferred embodiment without departing from the invention. Therefore, to particularly point out and distinctly claim the subject matter regarded as the invention, the following claims conclude this specification.

What is claimed is:

1. In a casement window having a frame including first and second spaced frame jambs, a head and a sill, and a sash including spaced sash sides and spaced sash ends about a sash panel, said sash being hinged to said first frame jamb for opening and closure, an improved casement window securement mechanism, comprising:

a first sash catch on one of said sash sides;

a second sash catch on said one sash side and being spaced apart from said first sash catch;

a first cam rotatably mounted on said second frame jamb and being positioned for operative cooperation with said first sash catch during closure;

a second cam rotatably connected to said second frame jamb and being positioned spaced from said first cam for operative cooperation with said second sash catch during closure;

an elongated linkage arm connecting said second cam to said first cam for rotating said second cam in response to rotation of said first cam;

means for momentarily delaying the initial rotation of said second cam until after commencement of rotation of said first cam whereby said second cam remains motionless after said first cam has begun rotation to catch said first sash catch and draw the window closer to a closed position, thereby positioning the second catch within reach of the second cam.

2. The mechanism of claim 1 wherein said means includes a lost motion connection between said first and second cams and said linkage arm.

3. The mechanism of claim 2 wherein said means includes an elongated slot for providing said lost motion connection.

4. The mechanism of claim 3 wherein said slot is located in said second cam and slidably receives a portion of said linkage arm.

5. The mechanism of claim 3 wherein said slot is substantially parallel to the longitudinal axis of said linkage arm when said sash is open and substantially perpendicular to the longitudinal axis of said linkage arm when said sash is closed.

6. The mechanism of claim 1 wherein said linkage arm has a first end attached to said first cam for movement therewith and a second end attached to said second cam for moving said second cam in response to movement of said first cam after a period of lost motion movement of said second end of said linkage arm with respect to said second cam.

7. The mechanism of claim 1 wherein said second cam has a cam surface with a substantially straight drawing portion whereby said second cam draws said second catch at a rate varying with the cam angle of rotation.

8. The mechanism of claim 1 wherein said second cam is mounted on a cam spacer mounted on said second frame jamb, said cam spacer supporting said second cam against and absorbing forces and moments generated upon closure of said sash.

* * * * *